United States Patent [19]

Takahashi

[11] Patent Number: 5,043,187

[45] Date of Patent: Aug. 27, 1991

[54] COATING METHOD AND APPARATUS FOR REMOVING A SAGGING COATING

[75] Inventor: Masashi Takahashi, Yokohama, Japan

[73] Assignee: Kabushiki Kaisha Toshiba, Kawasaki, Japan

[21] Appl. No.: 343,870

[22] Filed: Apr. 27, 1989

[30] Foreign Application Priority Data

Apr. 27, 1988 [JP] Japan ..... 63-102714

[51] Int. Cl.[5] ..... B05D 1/18; B05D 3/12; B05B 13/06; B05C 11/02

[52] U.S. Cl. ..... 427/273; 427/277; 427/430.1; 118/102; 118/317; 118/323

[58] Field of Search ..... 427/273, 277, 336, 355, 427/430.1; 118/102, 105, 323, 317, 425

[56] References Cited

U.S. PATENT DOCUMENTS 4,151,312 4/1979 Compen ..... 427/273 X 4,632,053 12/1986 Villanueva et al. ..... 118/102 X

*Primary Examiner*—Evan Lawrence

*Attorney, Agent, or Firm*—Foley & Lardner

[57] ABSTRACT

A method whereby a coating layer is formed on an outer surface of a cylindrical substrate by dipping the cylindrical substrate in a coating solution containing dissolved material, and vertically removing the cylindrical substrate from the coating solution. The lower end portion of the substrate which has a thick portion as a sag formed by a run of the coating solution on the outer surface of the substrate is brought into contact with a tapered outer surface of a member having said tapered outer surface immediately after the substrate is removed from the coating solution. Thus, the thick portion is transferred from the lower end of the substrate to the tapered surface. Then, a solvent of the dissolved material is sprayed to an inner wall surface of the substrate while a gap is formed between the lower end of the substrate and the tapered surface, thereby removing the material from a lower end face and the inner wall surface of the substrate. A sag removing apparatus comprises a member having a tapered outer surface with a rotatable spray nozzle for spraying the inner wall of the substrate with a solvent.

8 Claims, 2 Drawing Sheets

COATING METHOD AND APPARATUS FOR REMOVING A SAGGING COATING

BACKGROUND OF THE INVENTION

1. Field of the Invention

The present invention relates to a method and apparatus for coating a solution on a surface of a hollow cylindrical substrate to form a coating layer and, more particularly, to a method and apparatus for forming a photosensitive layer on a surface of a drum used in an electrophotographic apparatus.

2. Description of the Related Art

In an electrophotographic apparatus such as a copying machine and a laser printer, an image is formed by using a photosensitive body consisting of a photo semiconductor. The surface of the photosensitive body is uniformly charged by corona discharge or the like. An electromagnetic wave representing an image of an original is projected on the charged surface of the photosensitive body to form an electrostatic latent image on this surface. A toner is attached to the latent image to visualize the latent image (development). The developed image is transferred to a transfer medium such as a sheet of paper. After image transfer, a residual toner left on the surface of the photosensitive body is scraped by a cleaning blade, and residual charge is neutralized upon radiation of light or corona discharge, thereby completing one copying cycle.

Inorganic photosensitive materials such as selenium, selenium-tellurium, arsenic selenide ($As_2Se_3$), and zinc oxide (ZnO) have been used as photosensitive materials in the above electro-photographic apparatus. However, selenium and selenium-tellurium have low hardnesses and short service lives, are toxic to humans, and have low softening points. The charging capacity and photosensitivity of arsenic selenide are greatly degraded by optical fatigue In addition, arsenic selenide is toxic and has poor temperature characteristics. Zinc oxide has poor plate wear resistance.

Amorphous silicon or an organic photoconductive material has been recently used in place of the above inorganic photosensitive materials. Amorphous silicon has a high Vicker's hardness, high plate wear resistance, and high impact resistance. In addition, amorphous silicon has a high photosensitivity in a wide wavelength range from the entire visible light range to a near infrared range. However, amorphous silicon has a small charge capacity, tends to cause image tailing, and is expensive.

An organic photoconductive material is cheaper than amorphous silicon and does not cause pollution. In addition, the plate wear resistance and photosensitivity of the organic photoconductive material can be improved by proper selection of the material. In particular, an organic photosensitive material of a multi-layered structure consisting of a charge generating layer in which electrons and holes are generated and a charge transport layer in which the electrons and holes are transported has received a great deal of attention as a material having excellent properties.

In order to form a multi-layered photoconductive layer on a surface of a hollow cylindrical conductive substrate, the substrate is dipped in a solution of an organic photoconductive material in an organic solvent and is removed therefrom in the vertical direction. The substrate with an organic photoconductive layer is dried. In this dipping method, since the substrate is removed from the solution in the vertical direction, a thick portion as a sag is formed at the lower end portion of the substrate by a run of the solution. In addition, the solution flows to the inner surface of the lower end of the substrate. Therefore, the organic photoconductive material is applied to the lower end face and the inner surface of the lower end.

Conventional techniques for removing the thick portion at the lower end portion include a method of wiping the thick portion with a cleaning tape dampened with a solvent (Japanese Patent Disclosure (Kokai) No. 60-194459, and a method of applying a solvent to the thick portion with a rotating brush (Japanese Patent Disclosure (Kokai) No. 60-9731). A conventional method of removing a material from the lower end face and the inner surface of the lower end of the cylindrical substrate is exemplified by a method of spraying a solvent from a rotary nozzle to the inner wall surface of the lower end of the substrate (Japanese Patent Disclosure (Kokai) No. 60-168154).

According to the methods using the cleaning tape and the rotating brush, however, the material applied to the inner wall surface of the cylindrical substrate cannot be removed. In addition, wear of the brush produces dust to contaminate the working atmosphere. In addition, the brush must be frequently replaced. The method of spraying the solvent from the nozzle cannot remove the material from the thick portion of the lower end portion of the substrate and the lower end face of the substrate.

There is no conventional method and apparatus for removing the thick portion from the lower end portion of the substrate and a material from the inner wall surface of the lower end of the substrate and the lower end face.

SUMMARY OF THE INVENTION

It is, therefore, an object of the present invention to provide a method and apparatus capable of removing a thick portion from a lower end portion of a substrate and a material from an inner wall surface of the lower end of the substrate and a lower end face thereof and repeatedly using a jig used to remove the thick portion and the attached material when the cylindrical substrate is dipped in a coating solution to form a film thereon.

In order to achieve the above object according to an aspect of the present invention, there is provided a method of forming a coating layer on an outer surface of a hollow cylindrical substrate, comprising:

dipping the cylindrical substrate in the coating solution in which an organic material is dissolved;

removing the cylindrical substrate from the coating solution while an axis of the cylindrical substrate is aligned with a vertical direction;

bringing a lower end portion of the substrate which has a thick portion as a sag formed by a run of the coating solution on the outer surface of the substrate into contact with a tapered outer circumferential surface of a member having said tapered outer surface immediately after the substrate is removed from the coating solution, and transferring the thick portion from the lower end of the substrate to the tapered surface; and spraying a solvent of the organic material to an inner wall surface of the substrate while a gap is formed between the lower end of the substrate and the tapered surface, thereby removing the material from a lower end face and the inner wall surface of the substrate.

In order to achieve the above object according to another aspect of the present invention, there is provided an apparatus comprising: sag removing means having a tapered outer circumferential surface which is brought into contact with a lower end of a hollow cylindrical substrate which is dipped in a solution containing an organic material and is formed with a coating layer after being removed from the solution; and solvent spraying means arranged in the sag removing means and rotatable to spray a solvent of the organic material on an inner wall surface of the substrate.

DETAILED DESCRIPTION OF THE PREFERRED EMBODIMENTS

The present invention will be described in detail with reference to the accompanying drawings.

Figure 1A:
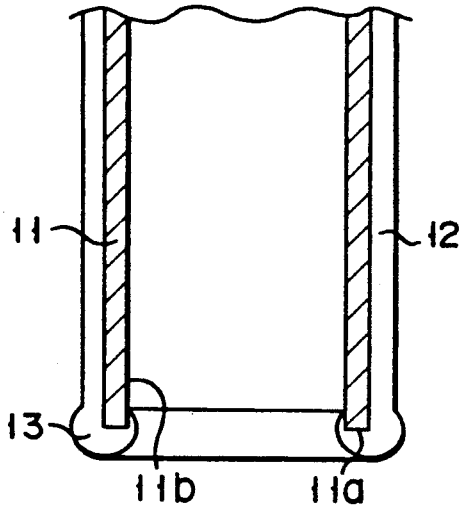
FIGS. 1A to 1E are views for explaining the steps of a method according to the present invention.

According to the present invention, by a known method, a hollow cylindrical substrate such as a drum is dipped in a coating solution obtained by dissolving an organic material such as an organic photoconductive material into an organic solution (e.g., cyclohexane or trichloroethane), and the cylindrical substrate is removed from the coating solution such that its axis is vertical. The viscosity of the coating solution generally falls within the range of 3 to 4 poise. The state of the cylindrical substrate, which is removed from the coating solution, is shown in FIG. 1A. Referring to FIG. 1A, a coating layer 12 is formed on the outer circumferential surface of a cylindrical substrate 11. The layer 12 forms a thick portion 13 as a sag at the lower end of the substrate 11. The coating solution is also attached to a lower end face 11*a* and an inner wall portion 11*b*.

Figure 1B:
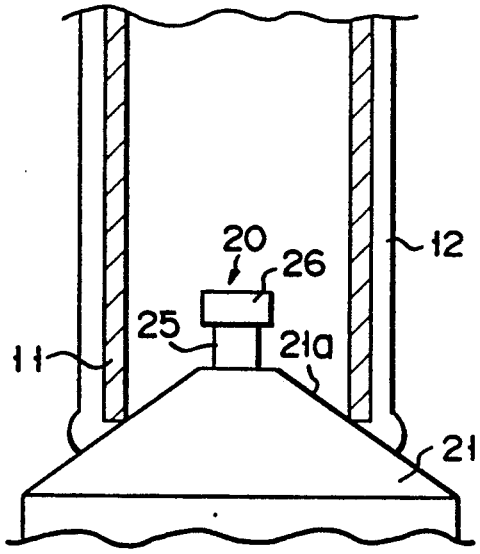

As shown in FIG. 1B, immediately after the substrate is removed from the coating solution, a sag removing member 20 is brought into contact with the lower end of the substrate 11. The removing member 20 is best illustrated in FIG. 2.

Figure 2:
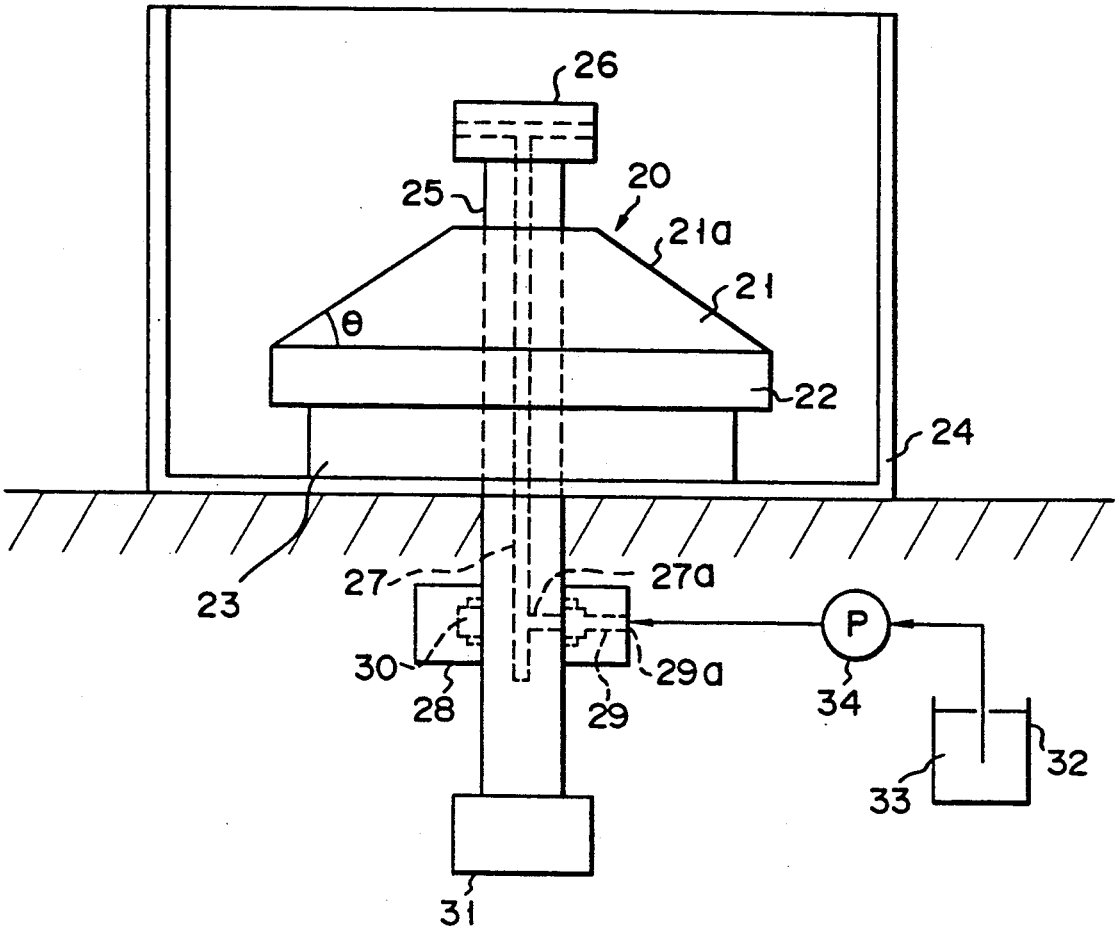
FIG. 2 is a schematic view showing an annular sag and a sag removing member used in the present invention.

As shown in FIG. 2, the sag removing member 20 has a frustoconical body 21. The lower end of an upwardly tapered, outer surface 21*a* of the body 21 is connected to a column portion 22. A tapering angle $\theta$ of the outer surface 21*a* of the body 21 preferably falls within the range of 10 to 45° and more preferably about 30°. The sag removing member 20 is supported by a columnar support 23 and is mounted in a tank 24. A columnar solvent spraying member 25 extends through the tank 24, the support 23, the column portion 22 and the body 21. The spraying member 25 extends from the upper end of the body 21 and a head 26 is arranged at the distal end of the spraying member 25. A solvent flow path 27 extends through the axis of the spraying member 25 and extends toward the head 26. The flow path 27 is branched in the head 26 and is open to the side surfaces of the head 26. The spraying member 25 is rotated by a motor 31.

Figure 1C:
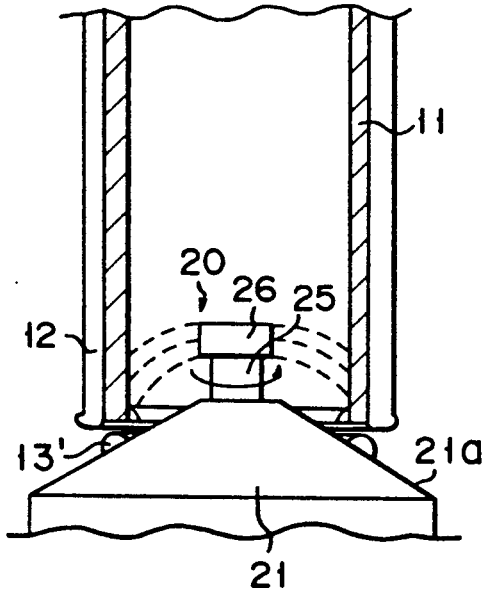

A stationary ring member 28 is fitted on a portion midway along the spraying member 25. A solvent path 29 having a port 30 is formed in the ring member 28 so as to open to the side surface of the ring member 28. The port 30 communicates with the flow path 27 through a branched flow path 27*a*. Therefore, the flow path 27*a* and the flow path 29 constitute a rotary joint. A solvent 33 stored in a tank 32 is supplied to an opening Referring back to FIG. 1B, the lower end of the substrate 11 is brought into contact with, or abutted against, the tapered surface 21*a* of the body 21 of the sag removing member 20. Thereafter, as shown in FIG. 1C, the substrate 11 is slightly moved upward to be separated from the tapered surface 21*a*. Most (13') of the sag 13 is transferred to the tapered surface 21*a*. However, in order to remove the material left on the lower end face 11*a* and the inner wall surface 11*b* of the substrate 11, the solvent is sprayed from the head 26 of the spraying member 25 while a gap is maintained between the tapered surface 21*a* and the substrate 11 and the spraying member 25 is rotated in a direction of an arrow. Upon spraying of the solvent, the material attached to the inner wall surface of the lower end portion of the substrate 11 is washed off, and at the same time, the material is washed off from the lower end face of the substrate. The material 13' attached on the outer surface 21*a* is also washed off by the solvent running along this surface 21*a*. In order to effectively wash off the material, the gap between the lower end of the substrate 11 and the tapered surface 21*a* and an amount of solvent to be sprayed are preferably controlled such that the solvent forms a laminar flow. Then, a uniform solvent vapor atmosphere is formed along the lower circumferential end of the substrate 11. Therefore, flowability of the sag 13 can be further improved by this atmosphere.

Figure 1D:
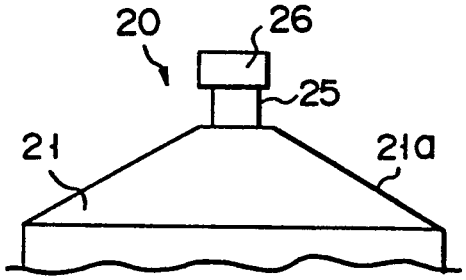
Figure 1E:
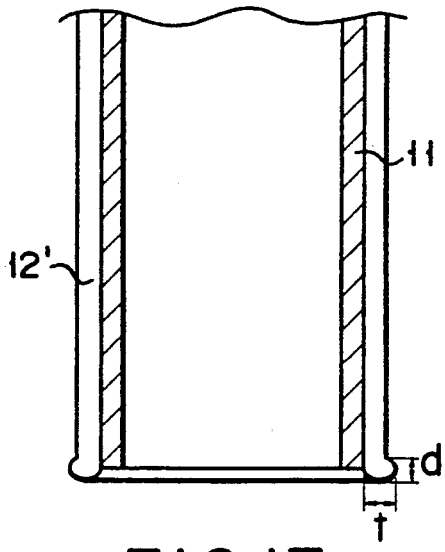

When solvent spraying is performed for a predetermined period of time, the solvent spraying is stopped and the substrate 11 is allowed to stand until no solvent drops. The tapered surface 21*a* is brought into contact with the lower end of the substrate 11 again, and thereby the remaining solvent is removed. As shown in FIG. 1D, the sag is removed from the tapered surface 21*a* of the sag removing member 20. As shown in FIG. 1E, a coating layer 12' without a sag on the lower end face and the inner wall surface can be obtained.

Figure 3:
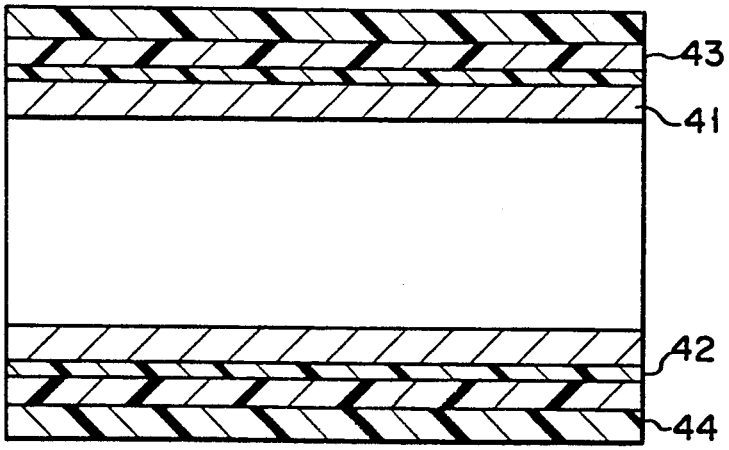
FIG. 3 is a sectional view showing a photosensitive drum manufactured by the method of the present invention.

FIG. 3 shows a section of a photosensitive drum formed by the present invention. A charge transport layer 43 consisting of an organic photoconductive material is formed on the outer surface of a cylindrical substrate 41 through an underlying layer 42 serving as an adhesive layer. A charge generating layer 44 consisting of an organic photoconductive material is formed on the charge transport layer 43. The present invention can be applied to formation of the charge transport layer 43 and the charge generating layer 44. However, the present invention is normally applied to formation of the charge generating layer 44.

EXAMPLE

A charge transport layer and a charge generating layer were formed on the surface of an aluminum cylindrical substrate to prepare a photosensitive drum having a structure shown in FIG. 3.

A hydrazone organic photoconductive material represented by formula (I)

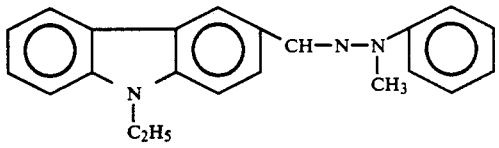

and a phenoxy organic photoconductive material represented by formula (II) (n is several hundreds to several thousands)

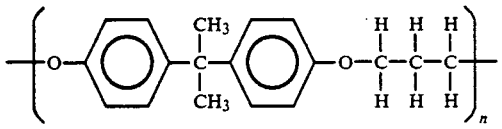

were mixed, and the resultant mixture was dissolved in cyclohexane. The substrate was dipped in this solution and was removed. The removed substrate was dried to form the charge transport layer 43.

Subsequently, a naphthol AS azon pigment represented by formula (III)

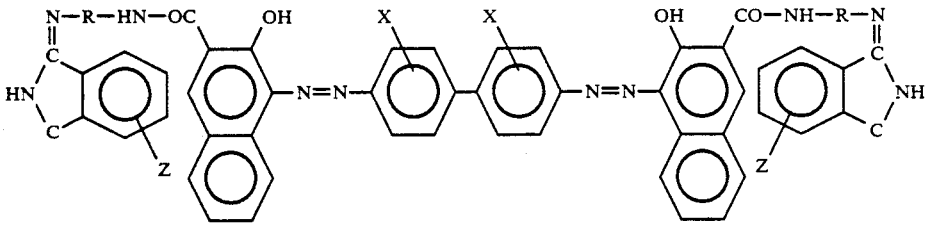

(wherein R is an alkylene group, X is a halogen atom, and Z is a substituent) and the organic photoconductive material represented by formula (I) were mixed, and the resultant mixture was dissolved in 1,1,2-trichloroethane. The substrate having the charge transport layer 33 thereon was dipped in this solution. Immediately after the substrate was removed from the solution, the lower end of the substrate was treated as described with reference to FIGS. 1A to 1E. In this case, the spraying solvent was 1,1,2-trichloroethane, and spraying time was about 20 seconds. During spraying of the solvent, the gap between the outer surface of the body and the lower end of the substrate was maintained to be 0.6 mm. After spraying of the solvent, the resultant structure was left to stand for about 5 seconds so as to allow the solvent to drip off.

After the lower end of the substrate was treated as described above, the resultant structure was forcibly dried. The presence/absence of a thick portion at the lower end portion of the cylindrical substrate 11 and the material attached to the lower end face and the inner wall surface of the substrate 11 was examined. A coating layer having a thickness t of 30 to 35 μm, which was almost equal to that of other portions, and a width d of 1 mm was left at the lower end portion (FIG. 1E). The material was not attached to the inner wall surface of the lower end portion and the lower end face of the cylindrical substrate 11, thus forming an ideal photoconductive layer.

As shown in FIG. 1C, the material 13' attached to the tapered surface 21*a* of the sag removing member 21 can be washed off upon spraying of the solvent. Therefore, the sags can be continuously removed by the sag removing member.

When the treatment of the lower end portion of the cylindrical substrate according to the present invention was not performed and the substrate was forcibly dried after the cylindrical substrate 11 was removed from the coating solution, the thickness of the coating layer was measured. The thickness of the photoconductive layer fell within the range of 18 to 20 μm, the thickness of the thick portion of the lower end was 120 μm or more, and the thickness of the material attached to the inner wall surface of the lower end portion fell within the range of 70 to 80 μm. In this manner, the material attached to the lower end face was found.

According to the treatment of the present invention after dipping of the cylindrical substrate, as has been described above in detail, the lower end of the cylindrical substrate is brought into contact with the tapered surface of the sag removing member, and the thick portion as a sag formed at the lower end portion of the cylindrical substrate and the material attached to the lower end face can be removed. In addition, the material attached to the inner wall surface of the lower end of the cylindrical substrate can be washed off upon spraying of the solvent of the coating solution from the rotary nozzle. At the same time, the material attached to the tapered or conical surface of the sag removing member can also be removed. Therefore, the coating apparatus can be repeatedly used.

According to the present invention as described above, the thick sagging portion formed at the lower end of the cylindrical substrate and the material attached both to the inner wall surface of the lower end and the lower end face can be easily removed In addition, the material attached to the tapered surface of the sag removing member can also be washed off during spraying of the solvent. Therefore, continuous film formation on the cylindrical substrate can be easily automated.

What is claimed is:

1. A method of forming a coating layer on an outer surface of a hollow cylindrical substrate, comprising the steps of:

dipping the cylindrical substrate in the coating solution containing dissolved material;

removing the cylindrical substrate from the coating solution while the cylindrical substrate is generally vertical, thereby coating the inner and outer surfaces of the substrate with a coating solution;

bringing a sag formed by a run of the coating solution on the outer surface of the substrate into contact with a tapered outer surface of a sag removing means immediately after the substrate is removed from the coating solution, and transferring the sag from the lower end of the substrate to the tapered surface; and spraying a solvent of the dissolved material on the inner wall surface of the substrate while a gap is formed between the lower end of the substrate and the tapered surface, thereby removing the material from the lower end face and the inner wall surface of the substrate.

2. A method according to claim 1, wherein the solution has a viscosity falling within a range of 3 to 4 centipoise.

3. A method according to claim 1, wherein the tapering angle of the tapered outer surface falls within a range of 10° to 45°.

4. A method according to claim 1, wherein said dissolved material comprises an organic material

5. A method according to claim 1, wherein said solvent used for said spraying is the same as used for said coating solution.

6. A sag removing apparatus comprising:

sag removing means having a tapered outer surface for receiving a generally vertically oriented hollow cylindrical substrate such that a lower end of the substrate having a coating layer formed on its inner and outer surfaces from a dipping thereof in a coating solution containing dissolved material and having a sag formed on its lower end, and for transferring the sag from the substrate to the tapered surface; and rotatable solvent spraying means arranged in said sag removing means for spraying a solvent for the dissolved material onto an inner wall surface of the substrate, thereby removing the dissolved material from the lower inner wall surface.

7. An apparatus according to claim 6, wherein the tapering angle of said tapered outer surface falls within a range of 10° to 45°.

8. An apparatus according to claim 6, wherein said solvent spraying means includes a nozzle extending through said sag removing means.

* * * * *